US007407124B1

(12) United States Patent
Layshon et al.

(10) Patent No.: US 7,407,124 B1
(45) Date of Patent: Aug. 5, 2008

(54) TABLET CRUSHER

(75) Inventors: Frank Layshon, Cambridge, OH (US); Paul Reeder, Worthington, OH (US)

(73) Assignee: Health Care Logistics, Inc., Circleville, OH (US)

( * ) Notice: Subject to any disclaimer, the term of this patent is extended or adjusted under 35 U.S.C. 154(b) by 939 days.

(21) Appl. No.: 10/673,301

(22) Filed: Sep. 29, 2003

(51) Int. Cl.
*B02C 19/00* (2006.01)

(52) U.S. Cl. ..... 241/268; 241/DIG. 27

(58) Field of Classification Search ..... 241/DIG. 17, 241/267, 268, DIG. 27
See application file for complete search history.

(56) References Cited

U.S. PATENT DOCUMENTS 5,915,637 A 6/1999 Parsons ..... 241/168
6,637,683 B1 * 10/2003 (Lomax) Wilbur ..... 241/101.2
6,966,509 B2 * 11/2005 Janzen ..... 241/169

* cited by examiner

*Primary Examiner*—Mark Rosenbaum
(74) *Attorney, Agent, or Firm*—Standley Law Group LLP

(57) ABSTRACT

The invention is a tablet crusher including a linkage that is operable to bring to bear a force on a platen so as to urge it against an anvil, wherein platen and anvil are shaped so as to bring about a crushing force upon a tablet disposed therebetween. The device comprises: (1) a base; (2) a fulcrum member integrally and immovably fixed to the base; (3) an anvil integrally fixed to the base, the anvil having a concave crushing face; (4) a movable handle pivotally coupled to the fulcrum member at a first pivot point; (5) a compression link, pivotally coupled at a first pivot to the base and coupled at a second pivot to the handle, for facilitating movement of the handle relative to the base; and (6) a platen having a convex crushing face, coupled at a third pivot to the base and coupled at a fourth pivot to the handle, whereby movement of the handle produces movement of the platen relative to the anvil, for crushing a tablet between the anvil and the platen.

7 Claims, 8 Drawing Sheets

TABLET CRUSHER

The present invention relates generally to tablet and pill crushing devices.

The preset invention is an improvement in tablet crushing devices of the prior art, including the tablet crusher described in U.S. Pat. No. 5,915,637, which is hereby incorporated herein by reference.

The present invention provides a tablet crushing device that may be constructed with fewer and less complicated parts, while providing a smooth and quiet crushing action, while providing all of the other advantages of earlier devices such as that described in U.S. Pat. No. 5,915,637. These other advantages include effective crushing of the tablet into small particle size, relatively easy hand operation of the device through the use of mechanical advantage, the ability to crush tablets of various size and shape, the elimination of the need for use of impact forces, and the reduction of risk of cross contamination from different medications.

Another advantage of the present invention is that the mechanism is designed to be simpler and to avoid any undue strain on load bearing parts. In this regard, the tablet crusher described in U.S. Pat. No. 5,915,637 uses a complex linkage that may be strained by excessive force.

Accordingly, there remains a need for a tablet crusher that is effective, efficient and relatively quiet in operation, and which offers all of the same advantages of prior art devices while eliminating some of the remaining disadvantages.

SUMMARY OF THE INVENTION

The present invention includes a tablet crusher that is quiet in operation and which does not rely on impact forces to crush pills.

In broadest terms, the tablet crusher of the present invention includes a linkage that is operable to bring to bear a force on a platen so as to urge it against an anvil, wherein platen and anvil are shaped so as to bring about a rolling crushing force upon a tablet disposed therebetween.

The preferred embodiment of the present invention is a device for crushing a tablet, comprising: (1) a base; (2) a fulcrum member integrally and immovably fixed to the base; (3) an anvil integrally fixed to the base, the anvil having a concave crushing face; (4) a movable handle pivotally coupled to the fulcrum member at a first pivot point; (5) a compression link, pivotally coupled at a first pivot to the base and coupled at a second pivot to the handle, for facilitating movement of the handle relative to the base; and (6) a platen having a convex crushing face, coupled at a third pivot to the base and coupled at a fourth pivot to the handle, whereby movement of the handle produces movement of the platen relative to the anvil, for crushing a tablet between the anvil and the platen.

The device of the present invention may preferably include a pouch for receiving a tablet to be crushed, the pouch being adapted for fitting between the anvil and the platen. The device of the present invention also may preferably include a cover fixed to the base, the cover including a storage means for storing a plurality of tablet receiving pouches.

The preferred embodiment of the invention affords several advantages compared to the prior art devices, such as those disclosed in U.S. Pat. No. 5,915,637. FIGS. 1 and 1A show a side elevational view of the tablet crusher described in U.S. Pat. No. 5,915,637. As can be seen from these Figures, the prior art device relies upon a complex four-point linkage that relies in part upon a moveable portion of the compression linkage 33P that moves along direction Y as the handle 15 is moved from the open position to the closed position along direction X. One of the disadvantages of this design, beyond its complex mechanical arrangement, is that any movement of the handle 15P beyond the maximum closed position (seen in FIG. 1A) must be absorbed by absorbing bumper 39P. Also, once the handle 15P reaches the maximum closed position, the absorbing bumper 39P begins to act as a fulcrum, causing an upward force to be brought to bear on pivot points A and D (rather than any further force directed to platen 27P along direction Z. Naturally, this also means that this device must be calibrated to be sure that the height of bumper 39P (if present) accords with the desired maximum travel of compression link 33P and handle 15P as well as platen 27P. Otherwise, the bumper will restrict the movement and give rise to the fulcrum effect described above.

The preferred embodiment of the present invention allows for the elimination of the moving compression link of the prior art device while providing for a smooth crushing force to be brought to bear on the tablet-crushing anvil.

Other aspects and advantages of the present invention will become apparent from the following detailed description, taken in conjunction with the accompanying drawings, illustrating by way of example the principles of the invention.

DETAILED DESCRIPTION AND BEST MODE OF THE INVENTION

Figure 1:
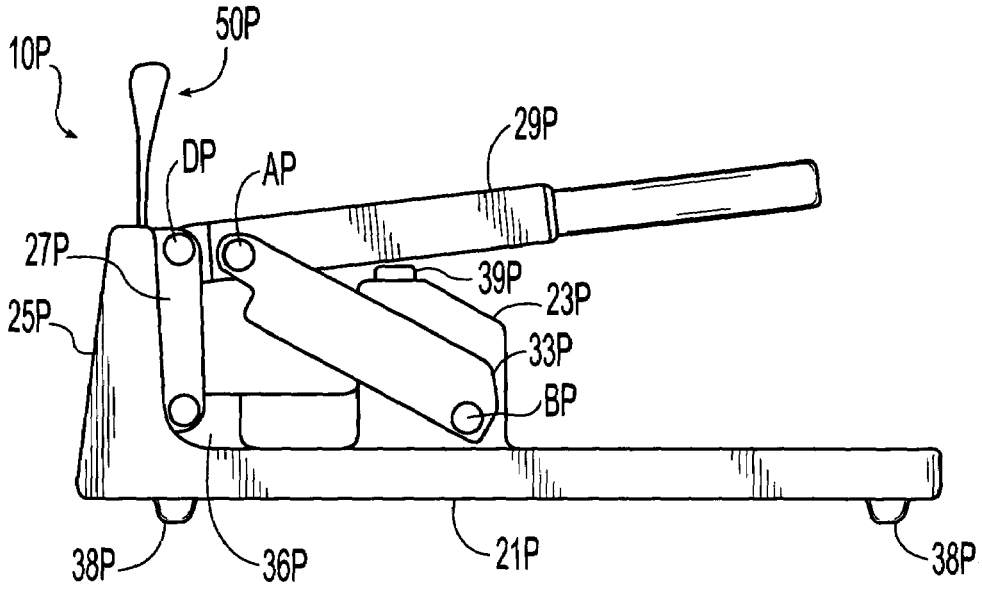
Fig. 1 (Prior Art)
FIG. 1 is a side elevational view of the tablet crusher described in U.S. Pat. No. 5,915,637 with the device in the open position.

In the following detailed description and in the several figures of the drawings, like elements are identified with like reference numerals.

With reference now to the drawings, there is shown a tablet crusher 10 that is constructed according to a preferred embodiment of the present invention. The tablet crusher 10 includes an elongated, generally rectangular base 11 from which an integrally formed anvil 13 projects upwardly. A platen 14 is pivotally connected to the anvil 13 (or alternatively to the base 11, not shown) by a pin or pivot E, for rotational movement of the platen 14 against the anvil 13. A handle 15 is pivotally connected to the fulcrum portion 16 by pin or pivot F. A compression link 17 is pivotally coupled at a first pivot to the handle portion 15 a pin or pivot G, and is also coupled by a second pin or pivot H to the platen 14, for facilitating movement of the platen 14 relative to the anvil 13.

The platen 14 and anvil 13 have correspondingly shaped curved crushing surfaces, the platen 14 having a convex crushing surface 18 and the anvil 13 a concave crushing surface 19. This shape allows the tablet crusher to perform the crushing function with greater smoothness, as the force of the platen against the anvil is more direct throughout the stroke of the handle 15.

The anvil 13 and the fulcrum portion 16 each may be integrally formed with the base 11, or may be attached as a separate piece by any known attachment means, such as through adhesives, welds or screws. Likewise, the fulcrum portion may be integrally formed with the base 11, or may be attached as a separate piece by any known attachment means, such as though adhesives, welds or screws.

Figure 1A:
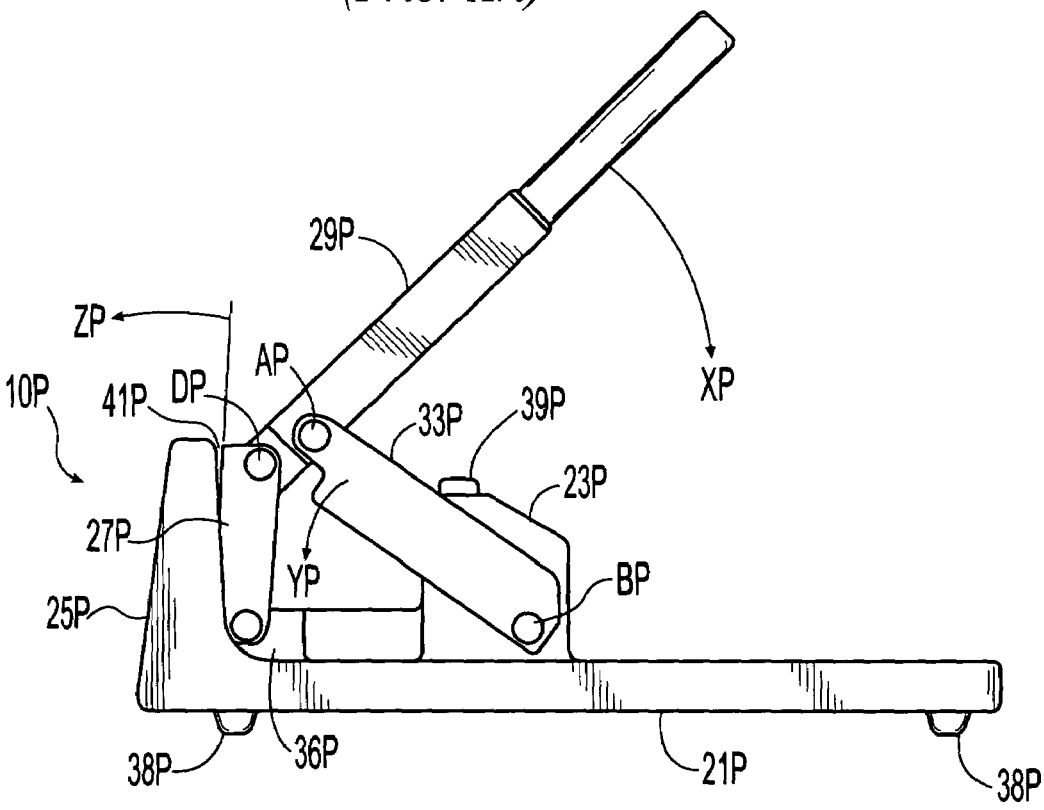
Fig. 1A (Prior Art)
FIG. 1A is a side elevational view of the tablet crusher described in U.S. Pat. No. 5,915,637 with the device in the closed position.

The distance of travel from the maximum open position to the fully closed position is also preferably determined such that the fully closed position is reached at the maximum point extension of the compression link. In contrast, devices of the prior art, as shown in FIGS. 1 and 1A, rely upon a linkage that permits movement of the handle beyond a point at which the platen and anvil are completely in the closed/crushing position. The effect of this arrangement is that once the handle has reached full actuation, it begins to place upward forces on the compression link, which halts the compression and may lead to weakness or breakage of the pins at the pivot points. Even the use of a stop (see item 39P of FIGS. 1 and 1A) leads to unnecessary upward force on the mechanism as it is stress at the end of the handle's downward stroke.

In contrast, the device of the present invention is preferably designed such that, at maximum closure position, the compression link and handle portions are not completely aligned (i.e., aligned horizontally), such that further movement of the handle cannot exert upward forces on the compression link. That is, the platen/anvil closure reaches maximum closure at a point before the axes of the handle and compression link member are collinear. The device of the present invention may be designed such that, at maximum closure position, the axes of the compression link and handle portions are completely aligned, in which case it is typically the case that the crushed tablet mass (with sufficiently tight tolerance between the platen and anvil, which is preferably quite tight) is sufficient to prevent the axes of the handle and compression link member from being aligned and thus the handle cannot exert upward forces on the compression link.

Another benefit of the curved platen and anvil faces is that the tablet, when placed in a pouch to be crushed, is crushed through a move uniform movement. This occurs because the curved opposing surfaces tend to allow initial fragmentation of the tablet to proceed such that tablet fragments more readily move upward from the bottom of the pouch while remaining within the envelope of the crushing zone as actuation proceeds. In this regard, because the pouches are typically flat, the curved faces permit greater space to allow fragmentation to occur and continue throughout the actuation stroke.

As an optional embodiment, the handle, fulcrum and/or compression link may be provided with an interference stop (not shown, but similar to item 39P except that it is disposed to stop the compression link short of full alignment) such that the handle and compression link stop short at complete alignment or just short of this point in the handle travel, so as to prevent unwanted upward force on link pinot G, while still allowing the platen to reach full closure against the anvil. An example of such an interference stop may be, for instance, an interfering structure placed along horizontal line 21 to prevent further downward movement of the handle beyond this point. In an optional embodiment, the compression link and platen travel may be designed such that the platen reaches full closure against the anvil before the compression link comes to full alignment, to prevent upward force being applied to the link.

Figure 2:
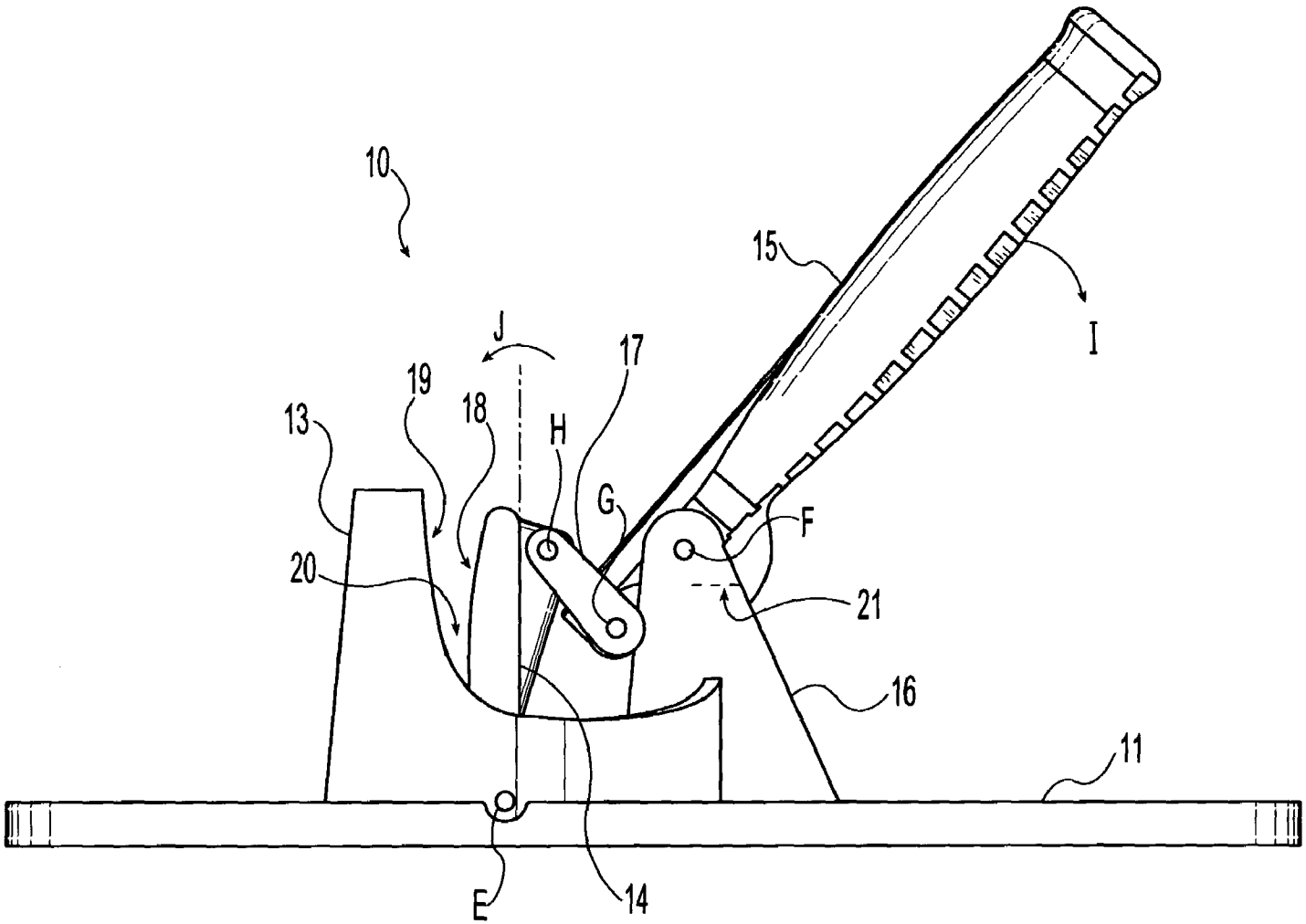
FIG. 2 is a side elevational view of the tablet crusher, with cover removed, in accordance with one embodiment of the present invention.
Figure 3:
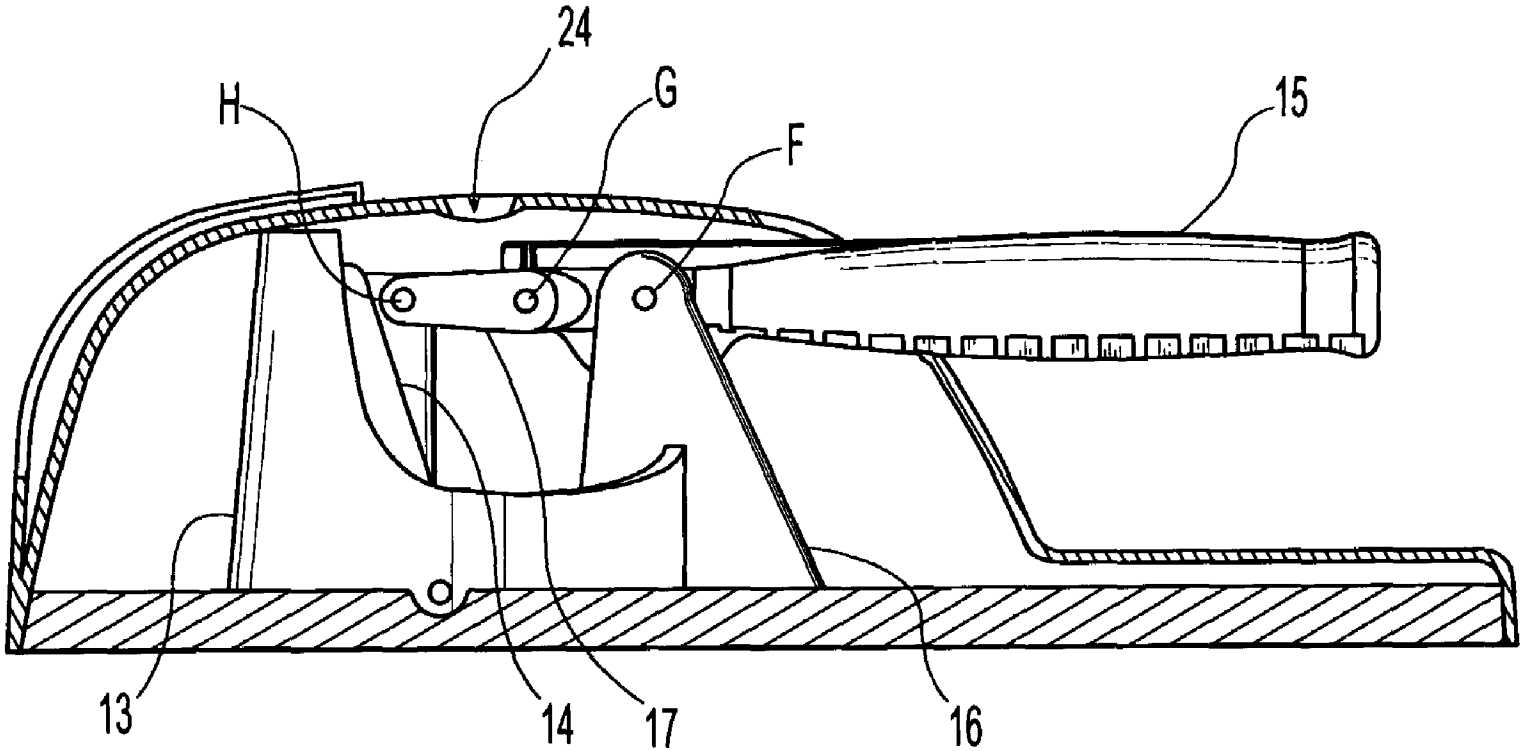
FIG. 3 is a side elevational sectioned view of the tablet crusher with cover in accordance with one embodiment of the present invention.
Figure 4:
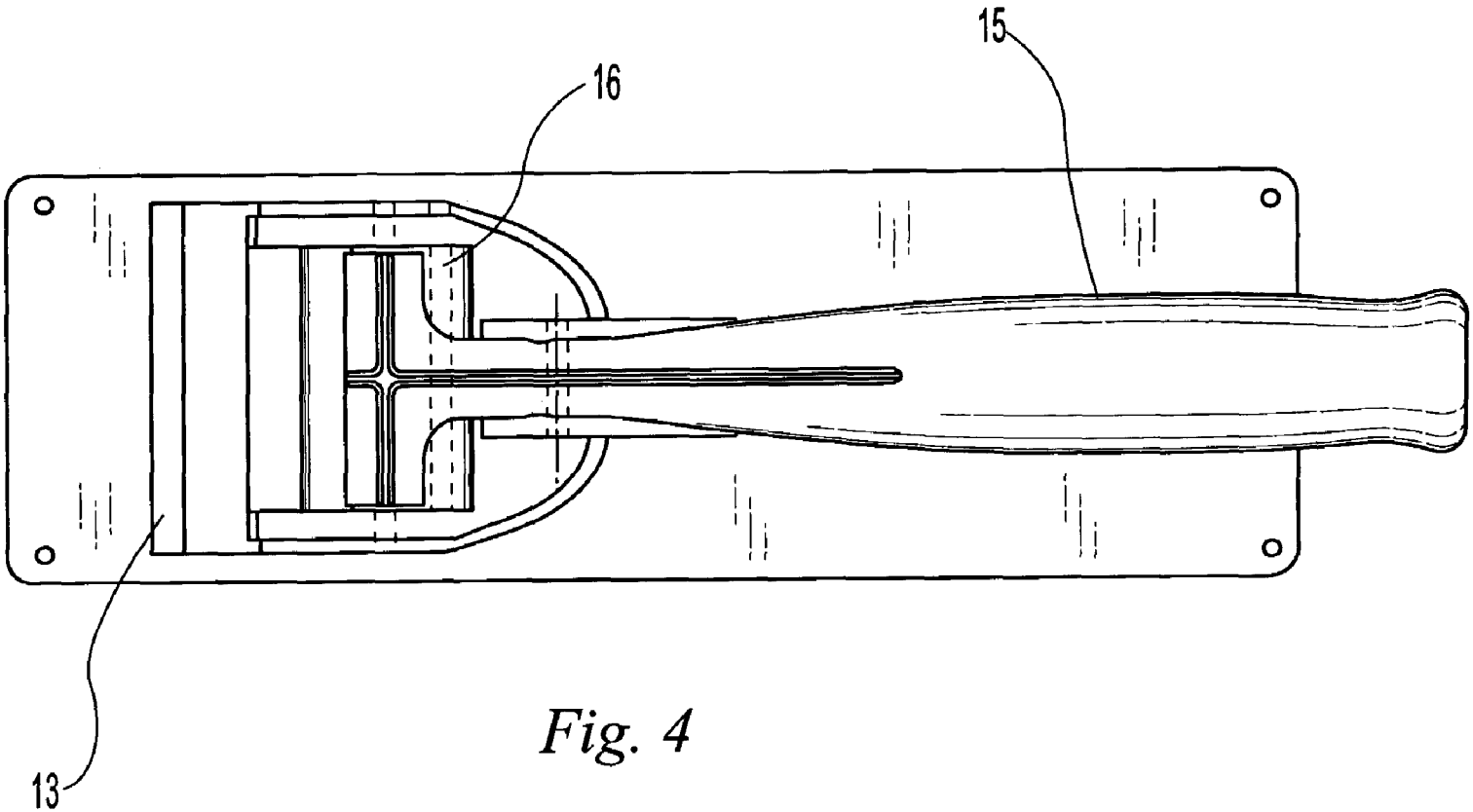
FIG. 4 is a top plan view of the tablet crusher with cover in accordance with one embodiment of the present invention.
Figure 5:
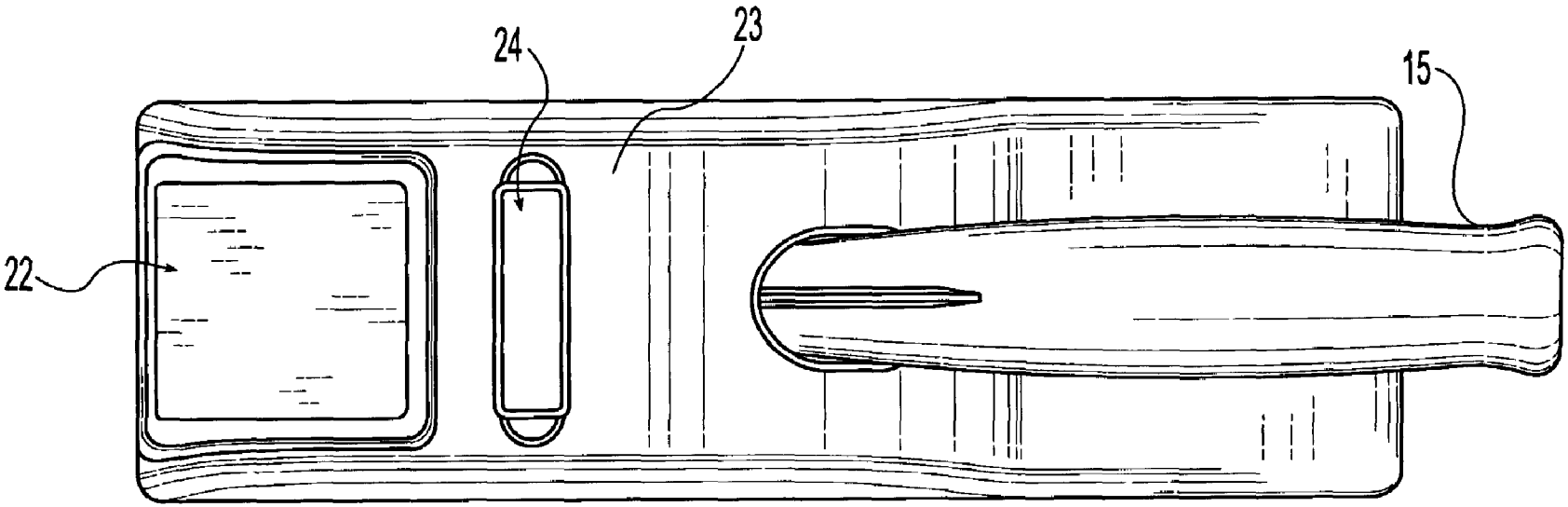
FIG. 5 is a top plan view of the tablet crusher with cover in accordance with one embodiment of the present invention.
Figure 6:
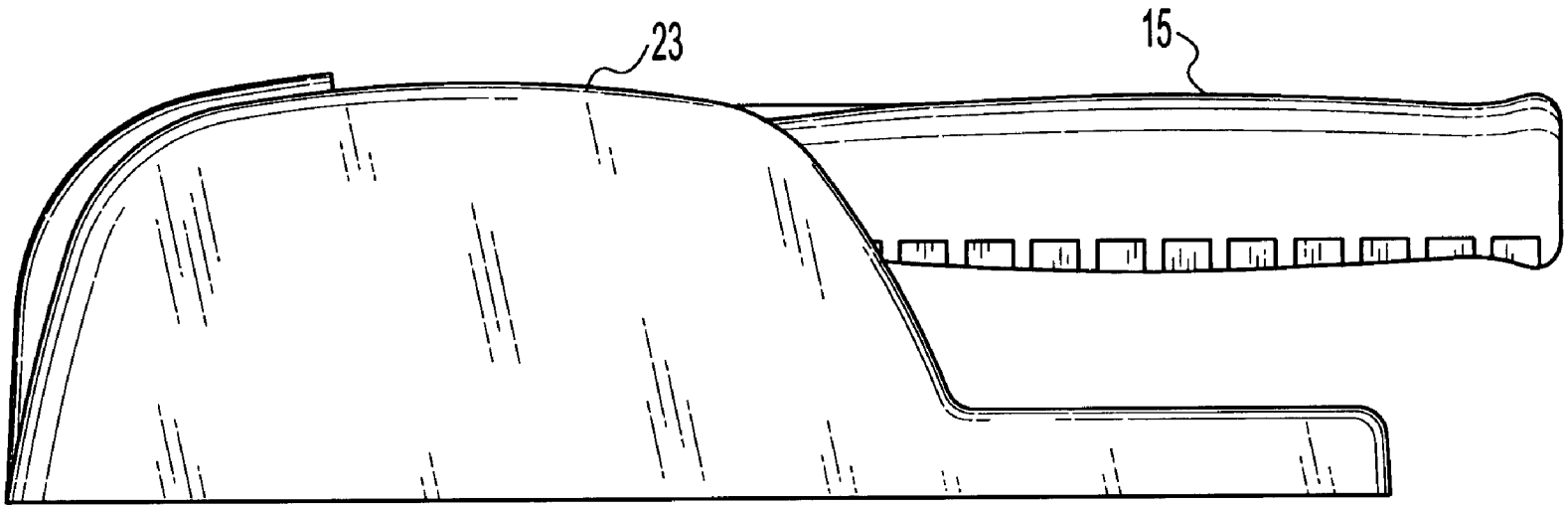
FIG. 6 is a side elevational view of the tablet crusher with cover in accordance with one embodiment of the present invention.
Figure 8:
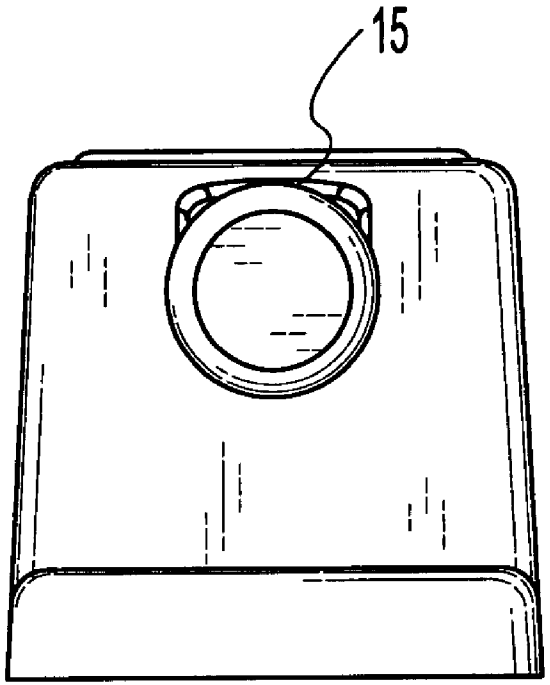
FIG. 8 is a front elevational view of the tablet crusher with cover in accordance with one embodiment of the present invention.
Figure 7:
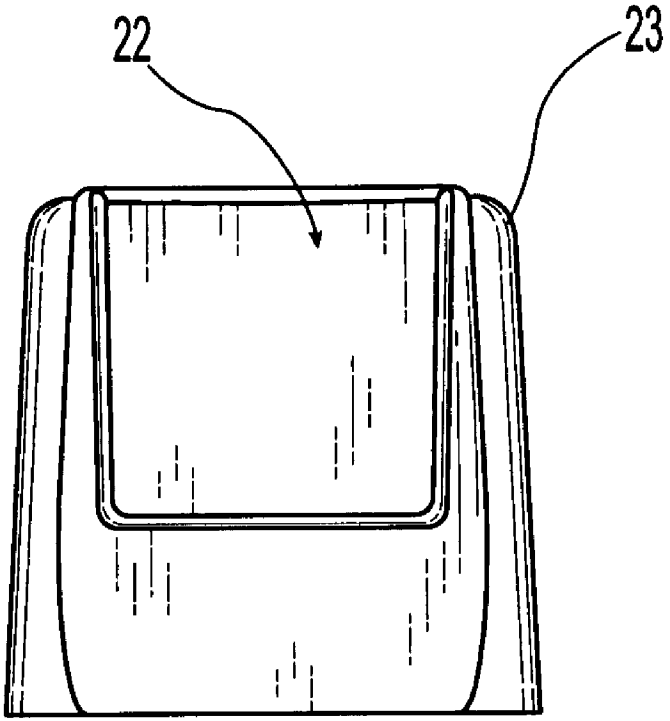
FIG. 7 is a rear elevational view of the tablet crusher with cover in accordance with one embodiment of the present invention.
Figure 9:
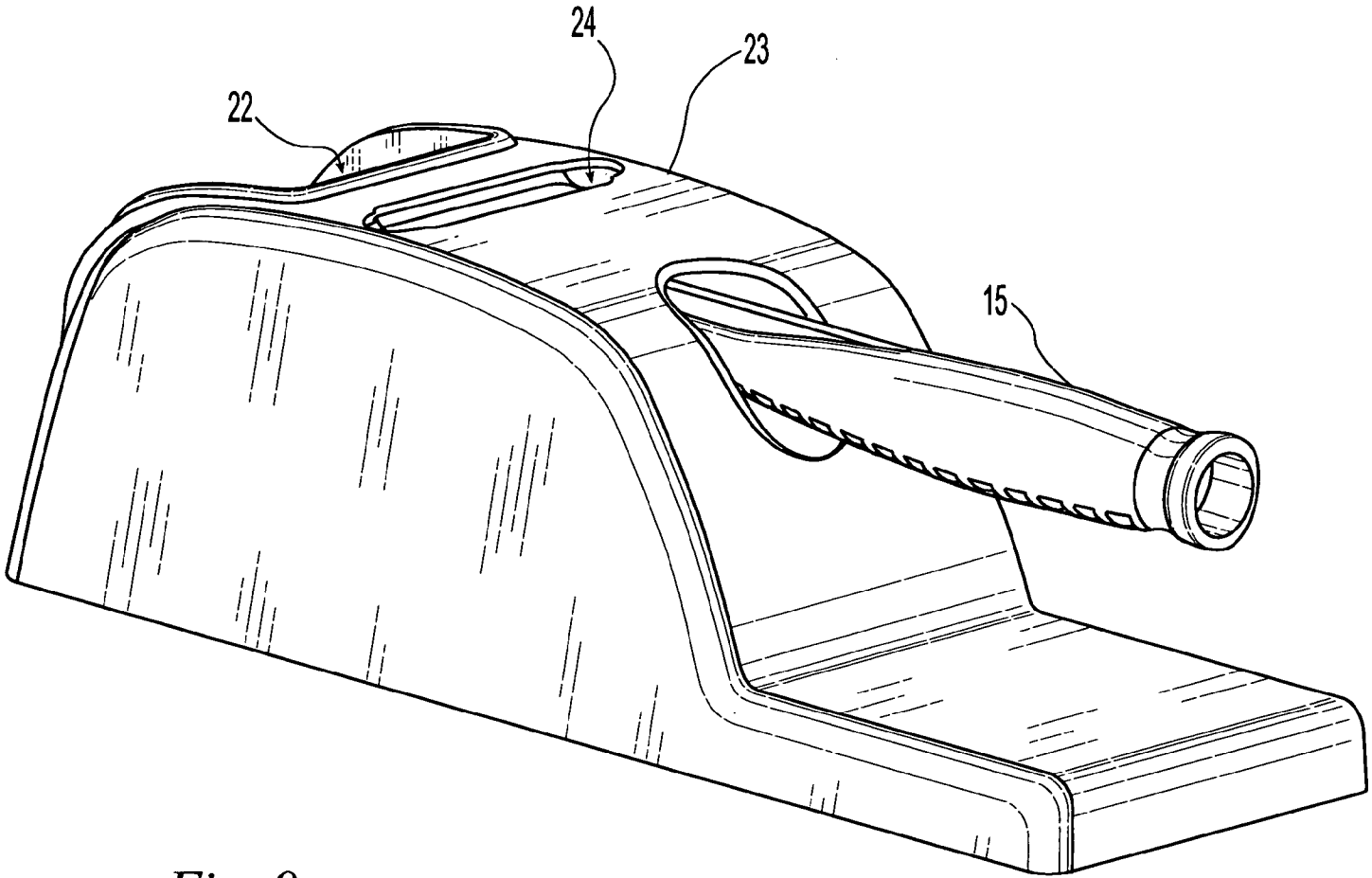
FIG. 9 is a perspective view of the tablet crusher with cover in accordance with one embodiment of the present invention.

During the tablet crushing process, pin F acts as a fixed fulcrum pivot, while pivots G and H act as floating pivots. After a pouch containing one or more pills is placed in the mouth 20, the handle 15 is moved in a direction indicated by the letter I (FIG. 2). As the handle moves downwardly, the compression link 17 causes the platen 14 to move in the direction indicated by the letter J.

In the preferred embodiment, the distance between the fully retracted platen and the anvil (shown in FIG. 2) anvil is set such that the complete alignment of the handle and compression link never achieved, thus preventing upward forces on pivot point G beyond the horizontal (movement that would actually retract the platen).

By action of the curved surfaces 18 and 19, crushing forces are brought to bear throughout the platen's travel against the anvil.

The device of the present invention may also be provided with a cover 23 to protect the mechanism. The cover 23 has an opening 24 to facilitate positioning of the pouch into the mouth of the device. The cover 23 also has cavity 22 to contain pouches for convenient dispensing of the pouches.

In operation, a pouch is removed from the pouch cavity 22 and one or more pills are placed in it. The pouch containing the pill(s) can then be inserted into the mouth 22 and, depending upon the degree of crushing desired the position of the pouch might be varied within the mouth 22. An advantage of the present invention is that the user can repeat the crushing operation, with the pouch 50 at a suitable level within the mouth 41, until the desired amount of pulverization is realized. In this regard, the transparent panels of the pouch 50 help the user determine whether additional crushing is needed.

The tablet crusher 10 may be made of any appropriately strong material, typically metal, as is known and used for these types of devices. As an alternative, the device may be made in part of a polycarbonate (e.g., glass filled).

The advantages of the invention when compared to the prior art include the ability to crush a tablet with a smooth stroke while helping to prevent jamming of the device and/or undue stress on the device due to over-extension of the actuation stroke. This eliminates the need for additional pieces such as in the prior art design, and the need for a complex mechanism that may require additional replacement parts. This reduces costs and extends the lifetime of the device.

It will be evident that there are additional embodiments and applications which are not disclosed in the detailed description but which clearly fall within the scope of the present invention. The specification is, therefore, intended not to be limiting, and the scope of the invention is to be limited only by the following claims. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All variations that come within the meaning and range of equivalency of the claims are to be embraced within their scope.

What is claimed is:

1. A device for crushing a tablet, comprising:

a base;

a fulcrum member, integrally and immovably fixed to the base;

an anvil, integrally fixed to the base;

a compression link;

a platen, pivotally connected directly or indirectly to the base at a first pivot point near a first end of the anvil and pivotally connected to the compression link at a second pivot point; and a handle, pivotally connected to the fulcrum member at a third pivot point and pivotally connected to the compression link at a fourth pivot point;

whereby pivotal movement of the handle about the third pivot point effects pivotal movement of the platen relative to the anvil about the first pivot point, for crushing the tablet positioned between the anvil and the platen.

2. The device according to claim 1, including a pouch for receiving a tablet to be crushed wherein said pouch is adapted for fitting between said anvil and said platen.

3. The device according to claim 1 wherein the distance of travel between a first position wherein said platen is fully withdrawn from said anvil and a second position wherein said platen is flush against said anvil, is sufficiently small to prevent said handle and said compression link from coming into full alignment.

4. The device according to claim 1, additionally comprising an interference stop structure positioned to prevent said handle and said compression link from coming into full alignment.

5. The device according to claim 1, additionally comprising a cover disposed over said platen and anvil, while having an opening to allow access to the space between said platen and said anvil.

6. The device according to claim 5 wherein said cover comprises an opening to a storage cavity.

7. The device of claim 1, wherein:

the platen and anvil having correspondingly shaped curved crushing surfaces.

* * * * *

UNITED STATES PATENT AND TRADEMARK OFFICE

CERTIFICATE OF CORRECTION

PATENT NO. : 7,407,124 B1
APPLICATION NO. : 10/673301
DATED : August 5, 2008
INVENTOR(S) : Frank Leyshon and Paul Reeder It is certified that error appears in the above-identified patent and that said Letters Patent is hereby corrected as shown below:

On cover page, item 75, please delete, “Frank Layshon” and insert --Frank Leyshon--.

Signed and Sealed this

Twenty-fourth Day of February, 2009

JOHN DOLL
*Acting Director of the United States Patent and Trademark Office*